United States Patent [19]

Contractor et al.

[11] 4,069,563

[45] Jan. 24, 1978

[54] PROCESS FOR MAKING NONWOVEN FABRIC

[75] Inventors: Rashmikant Maganlal Contractor, Wilmington; Birol Kirayoglu, Newark, both of Del.

[73] Assignee: E. I. Du Pont de Nemours and Company, Wilmington, Del.

[21] Appl. No.: 673,342

[22] Filed: Apr. 2, 1976

[51] Int. Cl.[2] ..... D04H 18/00; D04H 5/02

[52] U.S. Cl. ..... 28/105

[58] Field of Search ..... 28/72.2 F, 104, 105; 19/161 R, 161 P; 428/280, 281, 234, 134, 340, 227; 288/19; 156/277

[56] References Cited

U.S. PATENT DOCUMENTS

| | | | |
|---|---|---|---|
| 3,333,315 | 8/1967 | Dyer et al. | 28/72.2 F |
| 3,485,706 | 12/1969 | Evans | 19/161 R |
| 3,493,462 | 2/1970 | Bunting et al. | 28/72.2 F |
| 3,498,874 | 3/1970 | Evans et al. | 28/72.2 F |
| 4,021,284 | 5/1977 | Kalwaites | 156/277 |
| 4,024,612 | 5/1977 | Contractor et al. | 28/105 |

*Primary Examiner*—Louis K. Rimrodt

[57] ABSTRACT

The tensile strength of nonwoven fabric made by traversing a fibrous web on an apertured support with fine columnar streams of liquid is increased when the fine columnar streams are divided up into an array of a plurality of rows of streams, instead of a single row, with the streams in each row being staggered from one another and the rows being spaced 10 to 80 mils apart.

9 Claims, 3 Drawing Figures

PROCESS FOR MAKING NONWOVEN FABRIC

BACKGROUND OF THE INVENTION

This invention relates to an improved process for making a nonwoven fabric from a fibrous web.

Two basic processes are described in the literature for impinging fine columnar streams of liquid on a fibrous web to convert it by fiber entanglement into a nonwoven fabric. In one process, disclosed in U.S. Pat. No. 3,493,462 and 3,560,326, the apertured support is of such a fine mesh that the fabric has no pattern of apertures arising from the support but does have a pattern of lines of entangled fibers (jet tracks) reflecting the paths of impingement of the fine columnar streams across the surface of the fabric.

In the other process, disclosed in U.S. Pat. No. 3,485,706, for a given area weight web, the larger size of the apertures in the support in combination with the larger solid regions in the support cause apertures to form in the fabric in regions corresponding to the solid regions of the support. While impingement of the fine columnar streams of liquid on the web cause the fiber entanglement that holds the resultant fabric together, it is the apertured pattern appearance that is desired for the fabric.

In the practice of both processes, the orifices from which the streams of liquid issue have been arranged in a single row per bank. A bank is a series of orifices supplied with liquid by a single manifold. A series of banks of orifices in single rows have been used so as to provide a stepwise increase in impact pressure of the streams on the fibrous web. As shown in FIG. 41 of U.S. Pat. No. 3,485,706, these banks of manifolds (98) have been spaced far apart.

The streams of liquid have been columnar, i.e., as close to nondiverging as possible, so as to minimize the area of impingement of the stream on the web and thereby concentrate the entanglement force of the stream on the web. U.S. Pat. No. 3,403,862 discloses apparatus for improving columnarity of the streams. This patent also discloses that the spacing between stream orifices should "be sufficient to avoid interaction between adjacent streams" (column 4, lines 23–25). Interaction of the streams on their way to impinge on the web would increase the area of impingement of the streams on the web, thereby decreasing the entanglement force and efficiency of operation.

In the practice of both of the aforesaid processes the orifices in the single row in each bank have been spaced close together in order to get complete coverage of the streams over the face of the web, while avoiding the aforesaid interaction between adjacent streams. By way of example, the 5 mil (0.127 mm) diameter orifice has been used at a frequency of 40 orifices/inch (15.7/cm) which corresponds to a spacing between orifices (center-to-center) in the row of 25 mils (0.635 mm). This complete coverage has provided a jet track type fabric wherein the jet tracks are close together and uniformly faint in appearance so as to give this type of fabric a uniform appearance. With respect to the fabric having a pattern of apertures therein, even this complete coverage has not always provided the uniform pattern of apertures in the fabric. Occasionally, lines of fuzzy or indistinct apertures alternate with lines of distinct apertures in the fabric, which lines are believed attributable to interference between certain streams and certain repeat points in the topography of the apertured support for the web when such support is a screen. Such lines, which run in the direction of the passage of the web beneath the streams, can be called interference lines. These interference lines which vary in frequency and intensity from screen to screen have been erasable by passage of the web through a final row of streams spaced closer together than the proceding rows, e.g., using an orifice frequency of 60/inch (23.6/cm) for the 5 mil (0.127 mm) diameter orifice, whereby the resultant pattern of apertures in the fabric is uniform.

While these processes are effective in producing strong nonwoven fabrics by fiber entanglement alone, the problem has arisen of how to increase the efficiency of the liquid. While the liquid is recycled, nevertheless, the energy cost in pumping the liquid is high. This efficiency could manifest itself as the making of stronger fabric with the same amount of water; or using less water to get a fabric of equivalent strength; or using lower area weight fibrous web and getting a fabric of equivalent strength, which also increases the rate of production of the fabric.

SUMMARY OF THE INVENTION

The present invention provides an improvement in the process for making the above-described nonwoven fabrics, in the sense that more efficient operation of the process is possible. It has been discovered that when the fine columnar streams of liquid instead of being in a single row are divided up into an array of streams in a plurality of closely spaced rows in which the streams are staggered from row to row, the same amount of liquid will produce a stronger fabric, which can also lead to the other efficiencies hereinbefore disclosed.

More specifically, the present invention provides in the process of impinging a row of fine columnar streams of liquid onto a fibrous web supported on an apertured support passing therebeneath to produce by fiber entanglement a patterned nonwoven fabric, the improvement comprising impinging said streams onto said web as an array of streams in a plurality of rows in which the streams are staggered from row to row, said rows being spaced apart sufficiently to provide an increase in tensile strength of said fabric and spaced close enough to avoid substantially changing the pattern in the fabric, both as compared to when all said streams are in a single row.

Surprisingly, as the spacing between rows of streams increases, the tensile strength of the resultant nonwoven fabric, whether it be jet-track patterned or apertured patterned, sharply increases and then levels off. Unfortunately, however, at the same time the pattern in the fabric progressively changes towards a nonuniform appearance. In the case of the jet-track patterned fabric, excessive spacing between rows causes some of the jet tracks to be more prominent than others, giving the fabric a non-uniform and therefore undesirable appearance. This effect has been obtained using a plurality of rows of streams issuing from 7 mil diameter (0.18 mm) orifices in which the rows were spaced 100 mils (2.54 mm) apart. In the case of the aperture patterned fabric, excessive spacing between rows of streams gives a fabric having a nonuniform apertured appearance, which can be interference lines when the apertured support is a screen or can be just jet tracks superimposed over the apertured pattern.

Some small amount of pattern change is permissible because such amount of change is reversible to a uniform pattern appearance by final treatment of the web with an array of the streams closer together in the cross direction of the web than the preceding array of streams. In such case, the predominance of certain jet tracks over others in the jet-track fabric and presence of interference lines or jet tracks in an apertured fabric can be erased.

In any event, the spacing between rows of streams within which tensile strength increase occurs without substantial or irreversible change in the pattern appearance of the fabric is a small range; generally, the spacing between rows will be from about 10 to 80 mils (0.254 to 2.032 mm). Preferably, the spacing between rows is selected at which the increase in tensile strength is maximum while the change in pattern appearance in the fabric is minimum.

DESCRIPTION OF THE DRAWINGS

The present invention will be described in more detail hereinafter with reference to the accompanying drawings in which.

DETAILED DESCRIPTION OF THE INVENTION

Figure 1:
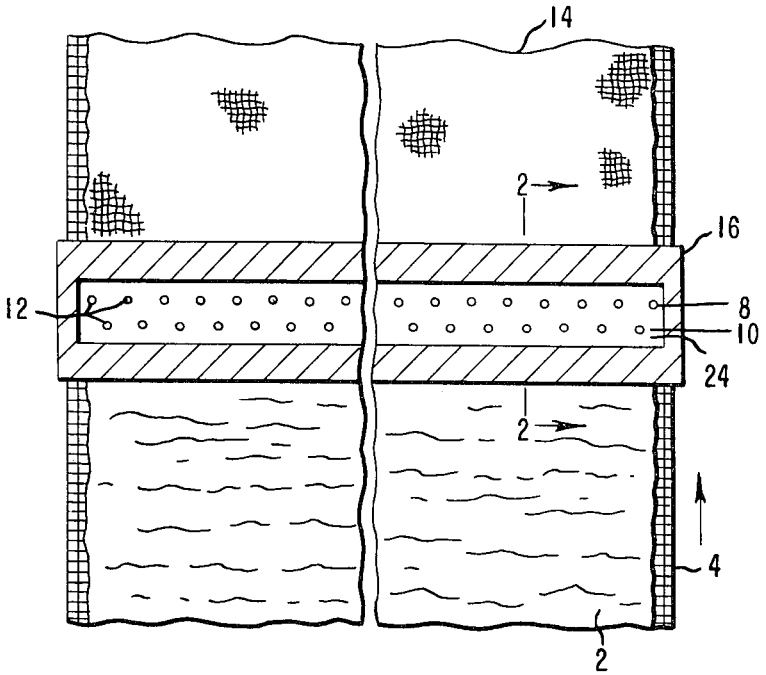
FIG. 1 is a schematic plan view in indeterminate width of a fibrous web passing beneath an array of fine columnar streams in a plurality of staggered rows; the streams are traveling into the plane of the drawing from a corresponding array of orifices supplied by liquid from an orifice manifold which is shown in cross section in the drawing.
Figure 2:
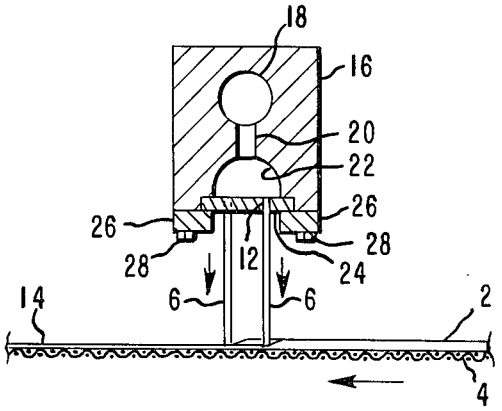
FIG. 2 shows schematically and in cross section along line 2—2 of FIG. 1, the orifice manifold of FIG. 1 and the array of fine columnar streams impinging on the fibrous web.

FIGS. 1 and 2 show a representative apparatus that can be used for carrying out the process of the present invention. In these Figs., a fibrous web 2 on an apertured support 4 is passed in the direction shown beneath an array of fine columnar streams 6 issuing from a plurality of rows 8 and 10 of orifices 12. The orifices in row 8 are staggered from the orifices in row 10, and the streams coming from these orifices are staggered accordingly. In FIG. 1, the orifices are shown spaced rather widely apart; this is done for purposes of clarity. In actual practice, the orifices are spaced much closer together.

As best shown in FIG. 2, the streams impinge on the web to convert it by fiber entanglement to a nonwoven fabric 14.

Also, as best shown in FIG. 2, the streams are columnar streams in that they have substantially straight sides, i.e., a divergence angle measured at the orifice 12 of less than 5°, preferably less than 3° and more preferably less than 1°. Because of this stream columnarity, the spacing between streams and between rows of streams will be described quantatively herein as distances between centers of the stream orifices and between the centerlines of rows of stream orifices, respectively. The streams are fine in the sense that the diameter of the stream orifices 12 is preferably from 3 to 10 mils (0.0762 to 0.254 mm).

The liquid, preferably water, is supplied to the orifices through a manifold body 16 which can be called a bank and in particular, the liquid is fed to both ends of a tubular chamber 18 passing through the upper part of the manifold body. The liquid then passes through a series of distribution channels 20 spaced across the bottom of the chamber 18 to a lower chamber 22 which is in communication with the stream orifices. The orifices are formed in a strip 24 and this strip is clamped to the bottom of the manifold body by retainer plate 26 secured to the body 16 by a series of bolts 28 spaced along the length of the body. Further details on construction of this apparatus is disclosed in U.S. Pat. Nos. 3,485,706, 3,403,862, and 3,613,999.

Figure 3:
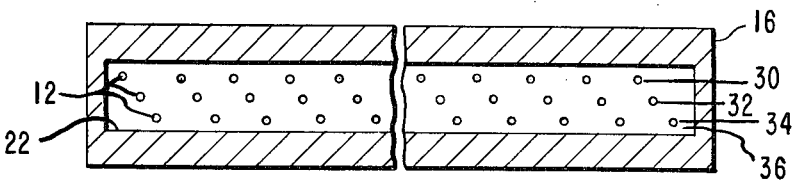
FIG. 3 is a schematic plan view in indeterminate width of another embodiment of an array of orifices in a plurality of staggered rows in an orifice manifold shown in cross section.

In accordance with the present invention, the orifices 12 are in the staggered row arrangement such as shown in FIG. 1. More than the two rows of orifices shown in FIG. 2 can be used. For example, three rows, 30, 32, and 34 of orifices 12 in strip 36 such as shown in FIG. 3 can be used in the same sort of manifold arrangement as just described.

A starting point of the present invention is the operation with a bank of a single row of orifices as in FIG. 42 of U.S. Pat. No. 3,485,706, wherein the orifice diameter and spacing between orifices has been selected to give maximum coverage of the impinging fine columnar streams of liquid across the width of the web as hereinbefore described.

In accordance with the discovery of the present invention, the orifices from the single row operation supplying complete coverage are divided up into more than one row. For example, a single row of orifices spaced 40/inch (15.7/cm) to provide maximum coverage across the web, would be rearranged in accordance with the embodiment of FIG. 1 of the present invention into two rows of 20 orifices/inch (7.9/cm) in each row, the orifices being equally spaced in each row and being staggered from one another from row to row. In the case of the embodiment of FIG. 3 of the present invention, each row would have about 13 orifices/inch (5.1/cm).

The position of orifices in one row relative to the other is such that the orifices are equally spaced across the width of the web 2. This equal spacing together with the fact that the same number of orifices are used provides the same complete coverage of the web by the fine columnar streams of liquid as compared to when all the streams are in a single row.

Despite this same complete coverage provided by the present invention as compared to single row operation, the dividing up of the orifices into a plurality of rows does affect the pattern of the fabric, as hereinbefore described, which makes the spacing between rows critical. Apparently, the single row complete coverage operation provides some interaction of the fine columnar streams at their points of impingement on the web which, in turn, provides the desired uniform pattern appearance. This interaction apparently diminishes as the orifices are divided up into at least two rows of orifices, which in effect moves adjacent orifices farther apart.

The maximum spacing between rows will depend on the effect on pattern appearance, which in turn will be affected by such operating conditions as size of the stream orifices, the type, length, denier of the fiber and the area weight of the web, and the particular apertured support for the fibrous web. The minimum spacing between rows is selected to give the increase in tensile strength desired.

Generally, the spacing between rows of orifices is from 10 to 80 mils (0.254 to 2.032 mm), within which both improved fabric strength and acceptable fabric appearance can be obtained, but the particular spacing within this range will be chosen to achieve optimum results for the particular set of operating conditions used. For the preferred orifices of 3 to 7 mils (0.0762 to 0.1778 mm) diameter, the preferred spacing between rows of streams of liquid is 15 to 50 mils (0.38 to 1.27 mm). Preferably, the frequency of orifices in each row of a double row array used in the present invention is from 10 to 35/inch (3.9 to 13.8/mm), with a corresponding decrease in orifice frequency to provide an equivalent spacing across the width of the web if more than two rows are used.

The changes in the pattern hereinbefore indicated resulting from the use of the array of streams in a plurality of rows can be erased if necessary by a final passage of the fabric beneath a bank of streams spaced closer together than in the preceding impingement steps, e.g., at 60 orifices/inch (23.6/cm). The effectiveness of this erasure is increased if these streams are also divided into a plurality of rows in accordance with the present invention. Preferably, however, the spacing between rows of streams in process of the present invention is close enough that no pattern change is visible in the fabric. This can eliminate the need for passage through the erasure streams of liquid which detracts from the efficiency of the process.

Further details on the operation of the process of the present invention, e.g., the fibrous web starting material, the apertured support, and the resultant fabric are disclosed in U.S. Pat. Nos. 3,493,462 and 3,485,706. By way of summary, liquid pressures of at least 14 kg/cm$^2$ gauge are preferably used and the energy flux of the fine columnar streams at the web is preferably at least 23,000 ft-poundals/in$^2$ sec (9000 joules/cm$^2$ min) to provide a total energy of impingement of at least 0.1 HP-hr/lb (0.14 Kcal/gm) of fabric. Usually, liquid pressures greater than 140 kg/cm$^2$ gauge will be unnecessary. The orifices are spaced close enough to the fibrous web, that the streams remain solid until impingement on the web.

Normally, more than one bank of orifices is used in order to increase liquid pressure stepwise in converting the fibrous web to fabric. The multiple row orifice arrangement used in the present invention can be used in each bank as desired. The use of multiple rows of orifices used in a single bank in the present invention is distinguishable from the multiple banks used in U.S. Pat. Nos. 3,493,462, 3,560,326 and 3,485,706 in that each bank of the prior art uses a single row of orifices and usually liquid pressure is increased from bank to bank in order to highly entangle the fibers of the fibrous web. In contrast, each row of orifices used in the present invention would provide less than the desired complete coverage of the web, which would provide by itself either a jet-tracked fabric in which the jet tracks were too far apart for the desired appearance or an apertured fabric in which aperture clarity was low. In addition, all the rows of orifices in a single manifold bank in the present invention are under the same liquid pressure. The inclusion of more than one row in the same bank in the present invention also permits staggering of the orifices from row to row, which as a practical matter is not possible when each row is in a separate bank as in the prior art. In the prior art, the banks of single rows of orifices are spaced so far apart, e.g., at least 5 inches (127 mm), that the beneficial effect of the closely spaced rows on fabric pattern appearance is lost.

Examples of fibrous webs that can be used in the present invention are carded on random webs of staple fibers of naturally occurring materials such as cotton or artificial materials such as polyamide, polyester, and rayon.

Choice of the apertured support will depend on whether the jet-tracked or apertured type of pattern is desired in the fabric and on the area weight of the fibrous web being treated thereon. For a given apertured support as the area weight of the web supported thereon increases, the fabric turns from an aperture-patterned fabric to a jet-track-patterned fabric. The apertured fabric can be considered as being a substrate-patterned fabric, i.e., the apertured support provides the pattern to the fabric as will be explained in greater detail hereinafter, while the jet-tracked fabric can be considered to be stream patterned, i.e., by the fine columnar streams of liquid impinging on the web.

Generally to make an apertured fabric, the apertured support will consist of a woven wire screen having a mesh of about 60 (23.6 wires/cm) and less in at least one direction and open area of at least about 20% or an apertured plate having the corresponding number of openings an open area. To make a jet-track product, the apertured support can have a mesh of at least about 75 (30 wires/cm) or corresponding number of openings in both directions.

The apertured nonwoven fabric produced by the process of the present invention is characterized by dense fiber entangled regions in which the fiber entanglement is three-dimensional, i.e., the fibers run and are entangled through the thickness of the fabric. The fiber entangled regions are interconnected by groups of fibers, and the fiber entangled regions together with the interconnecting fiber groups define the apertures in the fabric. The jet-tracked nonwoven fabric produced by the process of the present invention has no regular pattern of apertures which are visible to the naked eye and preferably has at least about 30 jet tracks per inch (11.8/cm) and more preferably at least about 40/inch (15.7/cm).

The apertured pattern of the apertured fabric will depend on the apertured. In woven wire screen supports, the apertures in the fabric form in the regions of the knuckles formed by the crimp of the interwoven wires of the screen. Some screens have low knuckles and high knuckles in the screen surface facing the fibrous web; this arises, for example, when the warp wire is crimped more than the shute wire of the screen such as shown in FIG. 14 of U.S. Pat. No. 3,485,706. In that case, a low area weight fibrous web will produce a fabric with apertures corresponding to all knuckles in the screen surface facing the web as shown in FIGS. 13 and 14 of that patent. As the basis weight of the web increases, the apertures corresponding to the lower knuckles fill in with fibers until only the higher knuckle-formed apertures are visible as such as shown in FIGS. 17 and 17*a* of U.S. Pat. No. 3,485,706. When the apertured support is a perforated plate, the apertures in the fabric are formed in regions corresponding to solid portions of the plate. For both the screen and plate supports, the dense fiber entangled regions are formed where the apertures are located in the support.

The basis weight of the web is selected depending on the utility desired for the fabric, such as disclosed in U.S. Pat. Nos. 3,485,706 and 3,560,326. Generally, the web basis weight will be from 0.5 to 3.5 oz/yd$^2$ (17 to 118.7 g/m$^2$) and preferably from 0.8 to 2.2 oz/yd$^2$ (27 to 74.6 g/m$^2$).

Examples of the present invention are as follows (all water pressures are gauge pressures):

EXAMPLE 1

This series of experiments shows the effect of the fine columnar streams being in a plurality of staggered rows rather than a single row and the effect of spacing between rows.

General Procedure: The web used was a random web of 1.2 oz/yd$^2$ (40.7 g/m$^2$) poly(ethylene terephthalate) staple fiber 0.75 inch (1.9 cm) long and 1.25 dpf. The web was wet down with water while supported on a 100 × 96 wires/inch (3.9 × 3.8 wires/mm) screen having 20% open area and passed beneath a bank of orifices four times, operating first at a liquid pressure of 400 psi (28 kg/cm$^2$), then at 700 psi (49 kg/cm$^2$) and finally two passes at 1700 psi (119 kg/cm$^2$). The web was removed from the screen and placed with the treated face down on a 24 × 24 wires/inch (0.9 × 0.9 wires/mm) screen having a 21% open area in which the wire of greater crimp was flat and was oriented in the machine direction of the operation. These passes of the web beneath a bank of orifices were made, first operating at 500 psi (35 kg/cm$^2$), then at 1700 psi (119 kg/cm$^2$) and finally at 1800 psi (126 kg/cm$^2$) to produce a fabric having the appearance of FIG. 15 of U.S. Pat. No. 3,485,706. The orifice diameter in all cases was 5 mils (0.127 mm) and the streams of water coming from them were columnar having a divergence angle of less than 1°. The rate of passage of the web beneath each bank of orifices was 18.3 m/min. The fabrics were tested for tensile strength by the cut strip method described in ASTM Test Method D-1117-69 Section 6.1.2 except using a sample length of 3 inches (7.62 cm), an Instron testing machine, a 2 inch (5.08 cm) gauge length, a rate of elongation of 50%/min and normalizing the test results for variations in sample area weight. The results were as follows:

| Orifice Bank | | | Strip Tensile Strength g/cm/g/m$^2$ | | |
|---|---|---|---|---|---|
| Orifices/ in. (cm)/ row | No. of rows | Spacing between rows - mils (mm) | Machine direction | Cross direction | Machine plus cross direction |
| 40 (15.7) | 1 | 0 (control) | 37.5 | 30.1 | 67.6 |
| 20 (7.9) | 2 | 10 (0.254) | 37.2 | 33.0 | 70.3 |
| 20 (7.9) | 2 | 20 (0.508) | 40.0 | 37.3 | 77.3 |
| 20 (7.9) | 2 | 40 (1.016) | 39.0 | 36.0 | 75.0 |
| 20 (7.9) | 2 | 80 (2.032) | 40.7 | 35.0 | 75.7 |

The two rows of 7.9 orifices/cm were arranged as in FIG. 1. In the case of 15.7 orifices/cm, the spacing between orifices (from centerline to centerline) in one row is 0.635 mm. In the case of 7.9 orifices/cm, the spacing between orifices in each row is 1.27 mm. For the spacing between rows of 1.016 mm, the distance from an orifice in one row to an orifice in the other row is 1.19 mm. All the measurements are made between orifice centers.

For the particular conditions used in this series of experiments, the maximum benefit of two rows of fine columnar streams impinging on the web over one row of the same number of streams is reached at about 0.508 mm spacing between rows. This is best seen by reference to the column in the Table listing the sum of the machine and cross direction strengths. Further increase in spacing between rows shows no strength benefit over the 0.508 mm spacing and in fact the fabric made using 1.02 mm spacing between rows has only a fair appearance in that interference lines are distinctly visible. These interference lines can, however, be minimized by a final pass of the web beneath a row of liquid streams spaced at 60/inch (about 23.6 cm) of web width and arranged in one or more rows. The fabrics produced using 0.254 and 0.508 mm spacing between rows have about the same appearance as the fabric produced with the single row of liquid stream; some interference lines are faintly visible but not to an objectionable amount. On the other hand, the fabric made using the 2.032 mm spacing between ross had a poor appearance in which the interference lines were very noticeable.

EXAMPLE 2

This example compares products made using orifices in two staggered rows with products made using a single row of orifices.

Sample of Invention

The starting web is a 1.9 oz/yd$^2$ (64.4 g/m$^2$) random web prepared by air-laydown from poly(ethylene terephthalte) staple fibers of 1.25 dpf and 0.75 inch (1.9 cm) length. The web is wetted down with water and then transferred to a 100 × 96 wires/inch (39.4 × 37.8 wires/cm) semitwill weave screen of 20% open area. The web on this screen is passed beneath orifices at a web-to-orifice spacing of about one inch (2.54 cm), from which orifices, essentially columnar water streams having a divergence angle generally less than 1° are jetted. Three types of manifolds containing orifices are used. Manifold A has 0.005 inch (0.127 mm) diameter orifices, spaced 40/inch (15.7/cm) in one row. Manifold B has 0.005 inch (0.127 mm) diameter orifices, in two rows the orifices being spaced 20/inch (7.9/cm) in each row and being staggered from row-to-row so that they provide a total coverage of 40 orifices per inch (15.7/cm) equally spaced across the web width. Manifold C has the same diameter orifices in 2 rows, with 30 orifices/inch (11.8/cm) in each row, the orifices being staggered from row-to-row to provide a total coverage of 60 orifices/inch (23.6/cm) equally spaced across the web width. In manifolds B and C, spacing between rows (centerline to centerline) is 0.040 inch (1.016 mm). The web is passed at 16 ypm (14.6 m/min) under 4 successive banks of manifolds at the following pressures (gauge):

| Bank | Manifold Type | psi | kg/cm$^2$ |
|---|---|---|---|
| 1 | A | 400 | 28.1 |
| 2 | A | 800 | 56.2 |
| 3 | B | 1800 | 126.5 |
| 4 | B | 1800 | 126.5 |

The web is then placed, treated face down on another screen having the same wire spacing and open area, and is passed at the same speed under three successive banks of manifolds at the following pressure (gauge):

| Bank | Manifold Type | psi | kg/cm$^2$ |
|---|---|---|---|
| 1 | A | 500 | 35.2 |
| 2 | B | 1900 | 133.6 |
| 3 | C | 1900 | 133.6 |

Comparison Sample

A comparison sample is made using the exact same conditions as above except that manifold A (single row of orifices) is used for all banks.

Both samples are dried and tested for grab strength using an Instron machine and ASTM method D-1682-69 with a clamping system having a 1 × 3 inch (2.54 × 7.62 cm) back face (with the 2.54 cm dimension in the vertical or pulling direction) and a 1.5 × 1 inch (3.81 × 2.54 cm) front face (with the 3.81 cm dimension in the vertical or pulling direction) to provide a clamping area of 2.54 × 2.54 cm. A 4 × 6 inch (10.16 × 15.24 cm) sample is tested with its long direction in the pulling direction and mounted between 2 sets of clamps at a 3-inch (7.62 cm) gauge length (i.e., length of sample between clamped areas). Results are:

| Grab Strength-kg | | | |
|---|---|---|---|
| Sample of Invention | | Comparison Sample | |
| MD | XD | MD | XD |
| 22.7 | 15.4 | 20 | 14.5 |

EXAMPLE 3

Example 2 is repeated with the following exceptions. The polyester web is 1.2 oz/yd$^2$ (40.7 g/m$^2$). Processing on the first screen is done at 25 ypm (22.86 m/min) and the following pressures (gauge):

| Bank | Manifold | psi | kg/cm$^2$ |
|---|---|---|---|
| 1 | A | 400 | 28.1 |
| 2 | A | 700 | 49.2 |
| 3 | B | 1700 | 119.5 |
| 4 | B | 1700 | 119.5 |

Processing on the second screen is done at 22.86 m/min and the following pressure (gauge):

| Bank | Manifold | psi | kg/cm$^2$ |
|---|---|---|---|
| 1 | A | 500 | 35.2 |
| 2 | B | 1700 | 119.5 |
| 3 | C | 1800 | 126.5 |

The comparison sample is made at the above conditions using manifold A in each bank. Properties are:

| Grab Strength-kg | | | |
|---|---|---|---|
| Sample of Invention | | Comparison Sample | |
| MD | XD | MD | XD |
| 13.2 | 9.1 | 11.8 | 8.2 |

EXAMPLE 4

Example 2 is repeated with the following exceptions. The polyester web regions 2.4 oz/yd$^2$ (81.4 g/m$^2$). Processing on the first screen is done at 12.5 ypm (11.43 m/min) and the following pressures (gauge):

| Bank | Manifold | psi | kg/cm$^2$ |
|---|---|---|---|
| 1 | A | 400 | 28.1 |
| 2 | A | 800 | 56.2 |
| 3 | B | 1700 | 119.5 |
| 4 | B | 1800 | 126.5 |

The second screen is a 20 × 20 wires/inch (7.9 × 7.9 wires/cm) screen having 41% open area and screen knuckles which are the same height in both screen directions. Processing on it is done at 11.43 m/min and the following pressures (gauge):

| Bank | Manifold | psi | kg/cm$^2$ |
|---|---|---|---|
| 1 | A | 500 | 35.2 |
| 2 | B | 1900 | 133.6 |
| 3 | C | 1900 | 133.6 |

The comparison sample is made as above using manifold A in all banks. Properties are:

| Grab Strength-kg | | | |
|---|---|---|---|
| Sample of Invention | | Comparison Sample | |
| MD | XD | MD | XD |
| 29.5 | 20 | 21.8 | 18.1 |

As many apparently widely different embodiments of this invention may be made without departing from the spirit and scope thereof, it is to be understood that this invention is not limited to the specific embodiments thereof except as defined in the appended claims.

What is claimed is:

1. In the process of impinging a row of fine columnar streams of liquid onto a fibrous web of staple fibers supported on an apertured support passing therebeneath to produce by fiber entanglement a patterned nonwoven fabric, the improvement comprising impinging said streams onto said web as an array of streams in a plurality of rows in which the streams are staggered from row to row, said streams being spaced apart sufficiently to provide an increase in tensile strength of said fabric and space close enough together to avoid substantially changing the pattern in the fabric, both as compared to when all said streams are in a single row, the spacing between said rows being from 0.254 to 2.032 mm.

2. In the process of claim 1 wherein said streams have an angle of divergence of less than 3°.

3. In the process of claim 1 wherein said streams have an angle of divergence of less than 1°.

4. In the process of claim 1 wherein said fabric has an apertured pattern.

5. In the process of claim 1 wherein said fabric has a jet-tracked pattern.

6. In the process of claim 1 wherein each row of said plurality of rows has from 10 to 35 streams/inch.

7. In the process of claim 1 wherein said rows are from 0.38 to 1.27 mm apart.

8. In the process of claim 1 wherein the orifices for said columnar streams impinging onto said fibrous web are 0.0762 to 0.254 mm in diameter.

9. In the process of claim 1 wherein the improvement includes impinging said streams onto both sides of said fibrous web.

* * * * *

UNITED STATES PATENT OFFICE

CERTIFICATE OF CORRECTION

PATENT NO. : 4,069,563

DATED : January 24, 1978

INVENTOR(S) : Rashmikant Maganlal Contractor & Birol Kirayoglu

It is certified that error appears in the above-identified patent and that said Letters Patent are hereby corrected as shown below:

Column 5, line 68, "on" should read -- or --.

Column 6, line 42, after "apertured" insert -- support --.

Column 8, line 9, "stream" should read -- streams --.

Column 9, line 62, "regions" should read -- weighs --.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*